US008042220B2

(12) United States Patent
Hittmann et al.

(10) Patent No.: US 8,042,220 B2
(45) Date of Patent: Oct. 25, 2011

(54) IMPLEMENT

(75) Inventors: Markus Hittmann, Kemen (DE); Uwe Gaese, Stuttgart (DE); Klaus Langhans, Winnenden (DE)

(73) Assignee: Andreas Stihl AG & Co. KG (DE)

( * ) Notice: Subject to any disclaimer, the term of this patent is extended or adjusted under 35 U.S.C. 154(b) by 174 days.

(21) Appl. No.: 12/469,600

(22) Filed: May 20, 2009

(65) Prior Publication Data

US 2009/0223017 A1 Sep. 10, 2009

Related U.S. Application Data

(63) Continuation-in-part of application No. 11/528,091, filed on Sep. 27, 2006, now Pat. No. 7,707,684.

(30) Foreign Application Priority Data

Sep. 28, 2005 (DE) ..... 10 2005 046 227

(51) Int. Cl.
*A47L 5/00* (2006.01)
*A47L 9/00* (2006.01)
*A47L 9/06* (2006.01)

(52) U.S. Cl. ..... 15/327.5; 15/405; 15/410

(58) Field of Classification Search ..... 15/327.5, 15/405, 410

See application file for complete search history.

(56) References Cited

U.S. PATENT DOCUMENTS

| | | | | |
|---|---|---|---|---|
| 3,039,339 | A * | 6/1962 | Hanson | 81/177.2 |
| 4,006,528 | A * | 2/1977 | Katsuya | 30/276 |
| 4,179,805 | A * | 12/1979 | Yamada | 30/122 |
| 4,282,652 | A | 8/1981 | Ballas, Sr. | |
| 4,288,171 | A | 9/1981 | Kottke | |
| 4,662,158 | A | 5/1987 | Zerrer | |
| D360,342 | S * | 7/1995 | Shea | D8/10 |
| 5,740,613 | A | 4/1998 | Swistun et al. | |
| 5,768,749 | A | 6/1998 | Ohi et al. | |
| 6,082,087 | A * | 7/2000 | Tada et al. | 56/255 |
| 6,305,048 | B1 | 10/2001 | Salisian | |
| 6,327,781 | B1 | 12/2001 | Sinclair et al. | |
| 6,701,623 | B2 | 3/2004 | Sanders | |
| 6,904,977 | B2 | 6/2005 | Zerrer et al. | |
| 6,928,693 | B1 * | 8/2005 | Ericson | 15/405 |
| 2001/0014576 | A1 | 8/2001 | Mannsperger et al. | |
| 2002/0110410 | A1 | 8/2002 | Karlsson | |
| 2005/0132531 | A1 | 6/2005 | Haberlein | |
| 2008/0092398 | A1 * | 4/2008 | Hurley et al. | 30/276 |

FOREIGN PATENT DOCUMENTS

| | | |
|---|---|---|
| DE | 20115631 | 3/2002 |
| DE | 202005001649 | 9/2005 |
| EP | 1400317 | 3/2004 |
| WO | WO 2006/018014 | 2/2006 |

* cited by examiner

*Primary Examiner* — Bryan R Muller
(74) *Attorney, Agent, or Firm* — Robert Becker; Robert Becker & Assoc.

(57) ABSTRACT

An implement comprising a first handle, on which are disposed control elements for the implement. A versatile use of an implement to which is secured a first handle can be provided if the first handle is secured to a tubular section of the implement via a clamp, whereby a handle is detachably mounted on the clamp and the clamp is mounted on the tubular section.

5 Claims, 4 Drawing Sheets

IMPLEMENT

CROSS-RELATED APPLICATIONS

This application is a continuation-in-part application of application Ser. No. 11/528,091, filed Sep. 27, 2006 now U.S. Pat. No. 7,707,684.

The instant application should be granted the priority date of Sep. 28, 2005 the filing date of the corresponding German patent application 10 2005 046 227.8-15.

BACKGROUND OF THE INVENTION

The present invention relates to an implement on which is secured a first handle, whereby the control elements, in particular the throttle trigger for operating a drive motor of the implement, are disposed on the first handle.

US 2005/0132531 A1 discloses an implement, namely a blower, having a handle for guiding the blower tube. The handle is disposed above the blower tube, and can be grasped ergonomically and conveniently only with one hand of the operator, so that the blower is suitable only for one-handed operation. Guiding the blower tube with only one hand can lead to operator fatigue.

It is therefore an object of the present application to provide an implement of the aforementioned general type that permits a fatigue-free operation and a versatile use.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
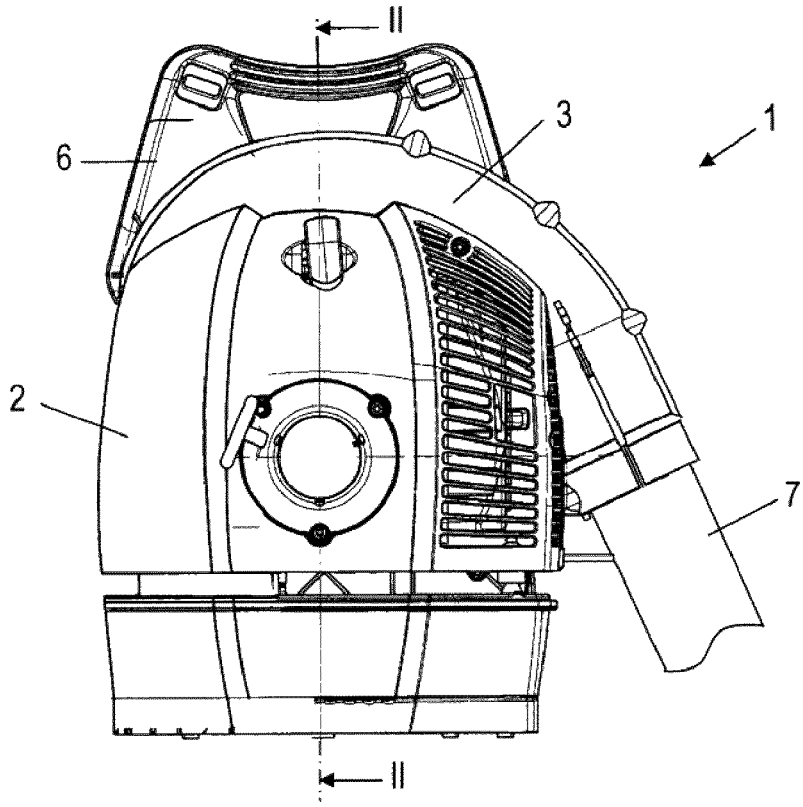
FIG. 1 shows a back view of a blower.

The implement of the present application comprises a tubular section and a clamp that is detachably mounted on the tubular section, wherein the first handle is detachably mounted on the clamp. As a result, the first handle can be removed from the clamp and can, for example, be used in conjunction with a handle frame for two-handed operation. Due to the fact that the first handle is not fixedly connected to the clamp, a versatile use of the implement is possible, for example for two-handed operation and for one-handed operation.

A handle frame, on which the first handle can be disposed, is advantageously provided for two-handed operation. The handle frame is preferably secured to the tubular section of the implement by means of a detachable clamp. Due to the fact that the clamp is detachably disposed on the tubular section, instead of the clamp for the handle frame having two handles, a clamp for the arrangement of a single handle can be secured to the tubular section. As a result, the implement can also be operated as previously with a single handle. The clamp expediently has a mounting support in which the handle frame is disposed in such a way as to be rotatable about the axis of rotation. As a result, a rotatability of the handle frame can be realized in a structurally straightforward manner.

The implement is in particular an implement that can be carried on an operator's back, preferably a blower, a suction device or a sprayer. The tubular section is in particular a section of the blower tube of the implement.

A versatile use of an implement to which is secured a first handle can be provided if the first handle is secured to a tubular section of the implement via a clamp, whereby a handle is detachably mounted on the clamp and the clamp is mounted on the tubular section. As a result, it is possible to exchange the first handle by a handle frame to which is secured a second handle, so that the implement can be guided not only with a single handle but also with two handles. This enables a flexible utilization of the implement. By means of the detachable mounting of the first handle on the clamp, the handle can be mounted on a handle frame, so that the control elements disposed on the first handle are available to the operator. It can be advantageous to have only one clamp for fixation of either the handle frame or a single handle to the tubular section. It can be advantageous that the clamp is detachably mounted on the tubular section. In this way it is possible to have different clamps for fixation of the handle or the handle frame to the tubular section.

The implement advantageously has a mounting support on which is disposed a handle frame, whereby the mounting support can be placed upon the clamp. As a result, it is possible to guide the implement with a handle frame that has two handles. Consequently, it is easily possible to operate with one handle, or selectively, after modifying the implement, with two handles. A holding fixture for the first handle is expediently disposed on the handle frame. The first handle, which carries the control elements, can thus be secured in position either in the holding fixture of the handle frame or directly on the clamp on the blower tube, depending upon whether single-handed operation or two-handed operation is desired. The handle is advantageously provided with an insertion region that is embodied in such a way that the handle can be placed not only upon the clamp but also upon the holding fixture. It is thus easily possible to modify the blower. A straightforward configuration results if the mounting support is provided with an insertion region that corresponds functionally to the insertion region of the handle. The mounting support and the handle can thereby be exchanged for one another on the clamp in order to modify the implement.

Further specific embodiments of the present application will be described in detail subsequently.

DESCRIPTION OF SPECIFIC EMBODIMENTS

Figure 2:
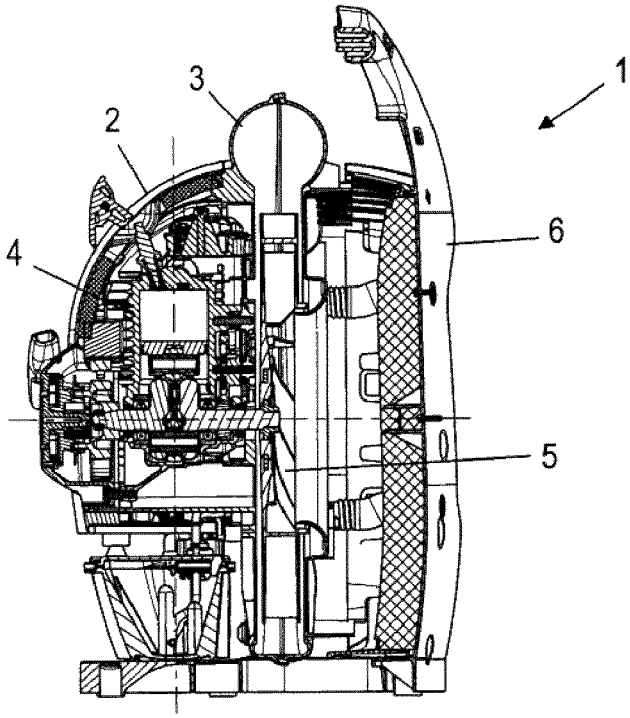
FIG. 2 is a cross-sectional view taken along the line II-II in FIG. 1.

Referring now to the drawings in detail, the blower 1 shown in FIGS. 1 and 2 has a housing 2 in which is disposed a drive motor 4 which is preferably an internal combustion engine, such as a two-cycle engine or a four-cycle engine. The drive motor 4 drives an impeller 5 that conveys air into a blower spiral or volute 3, on which is disposed a blower or discharge tube 7. The housing 2 is secured to a backpack 6, so that the operator can carry the blower 1 on his or her back. The blower tube 7 is guided around the body of an operator, is held by the operator, and is guided over the ground, so that dirt, leaves or the like can be removed from the ground.

Figure 3:
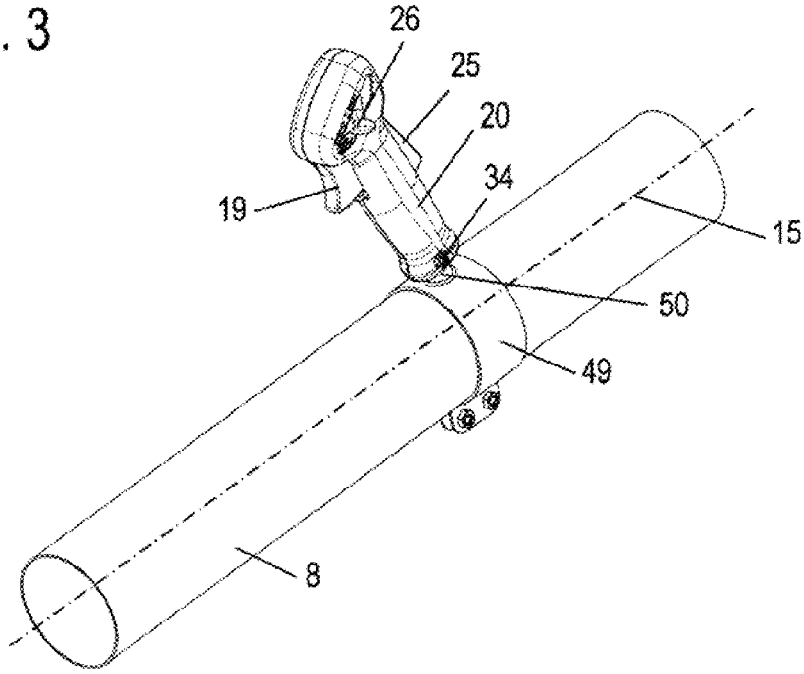
FIG. 3 shows the blower tube of the blower of FIGS. 1 and 2 with one handle for one-handed operation.

As shown in FIG. 3, a clamp 49 having the short tube 50 can be secured to the section 8 of the blower tube 7. A first handle 20 can be fixed on the short tube 50 via the set screw 34. As a result, the blower tube 7 can also be used with a previously conventional handle for single-handed operation if a two-handed operation is not desired. In this connection, the handle 20 is detachably fixed to the clamp 49, and the clamp 49 is detachably fixed to the blower tube 7. The first handle 20 has a throttle trigger 19, a throttle lock 25, as well as the control lever 26, which can serve, for example, for setting a choke or for fixing the throttle in one or in different positions.

Figure 4:
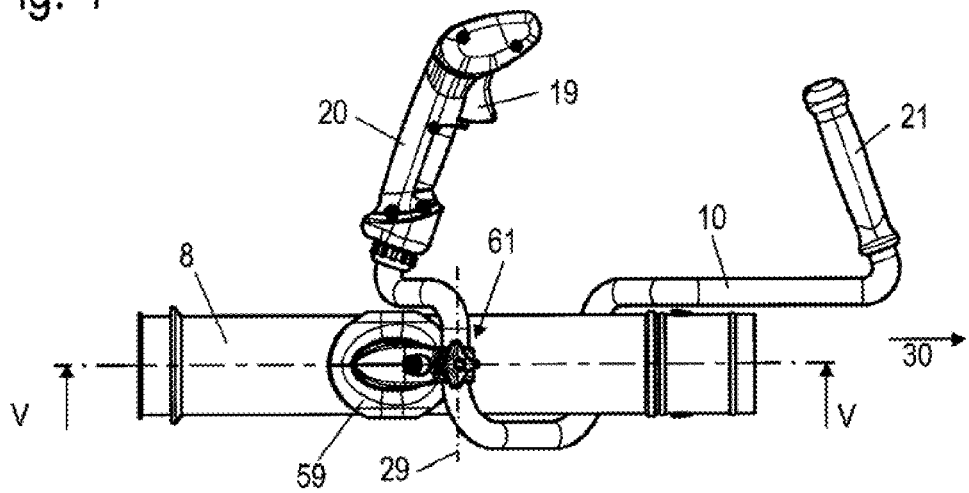
FIG. 4 is a side view of an embodiment of a blower tube with a handle frame.

FIG. 4 shows another embodiment of a section 8 of a blower tube 7 with a clamp 59. The clamp 59 has a mounting support 61 in which a grip or handle frame 10 is held. The handle frame 10 of FIG. 4 is provided for guiding the blower tube 7; secured to the handle frame 10 are the first handle 20 and a second handle 21. The handle frame 10 is formed of a bent tube onto the ends of which the handles 20 and 21 are placed and fixed. By means of the clamp 59, the handle frame 10 is secured in place on a section 8 of the blower tube 7 through which the air conveyed by the impeller 5 flows in the direction of flow 30.

Figure 5:
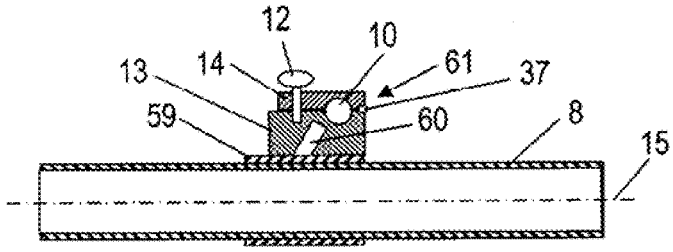
FIG. 5 is a cross-sectional view taken along the line V-V in FIG. 4.

The mounting support 61 has a first half sleeve 13, which is secured to the clamp 59. Mounted on the first half sleeve 13 is a second half sleeve 14, which is pivotably disposed on the first half sleeve 13 on a hinge 37. Secured to the second half sleeve 14 is a wing screw 12, which can be screwed into the first half sleeve 13. The handle frame 10 is disposed in the mounting support 61 so as to be rotatable about an axis of rotation 29. As shown in FIG. 5, the wing screw 12 is disposed on that side of the axis of rotation 29 that is opposite the hinge 37, so that the tubular handle frame 10 can be securely clamped in the mounting support 11.

As shown in FIG. 5 the mounting support 61 is detachably fixed on a short tube 60 of the clamp 59. The short tube 60 is firmly connected to the clamp 59 and extends in a lateral direction of the section 8 of the blower tube 7.

Figure 6:
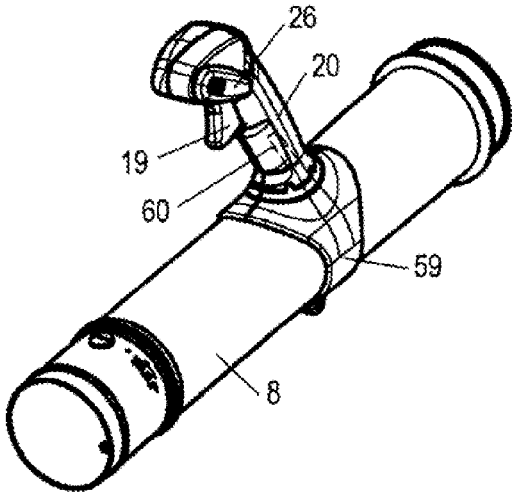
FIG. 6 shows the blower tube of FIG. 4 with one handle for one-handed operation.

As shown in FIG. 6, the handle 20 can be connected directly to the clamp 59 for single-handed operation if a two-handed operation is not desired. To use the clamp 59 with the handle 20, the mounting support shown in FIGS. 5 and 6 is detached from the short tube 60 and the handle 20 is detached from the handle frame 10. Then the clamp 59 is turned around the longitudinal direction 15 until the short tube 60 is in an upright position and the handle 20 is directly secured to the short tube 60 of the mounting support 61. The clamp 59 is advantageously turned about an angle of approximately 90°. Because either the mounting support 61 or the handle 20 can be secured to the short tube 60, only one clamp 59 is needed for fixation of the handle frame 10 or of the handle 20 to the blower tube 7.

Figure 7:
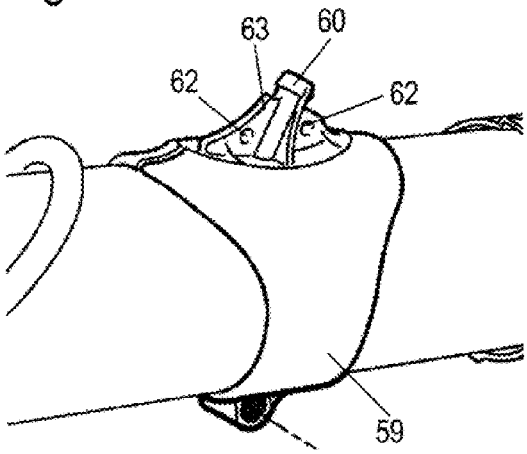
FIG. 7 is a perspective illustration of the blower tube with a clamp disposed thereon.

FIG. 7 shows the configuration of the clamp 59 with the short tube 60 in detail. As shown in FIG. 7, a longitudinal rib 63 is formed in the longitudinal direction of the blower tube 7 or section 8 thereof adjacent to the short tube 60; the longitudinal rib 63 fixes the rotational position of the mounting support 61 or the handle 20. Provided on the longitudinal rib 63 are two mounting openings 62.

Figure 8:
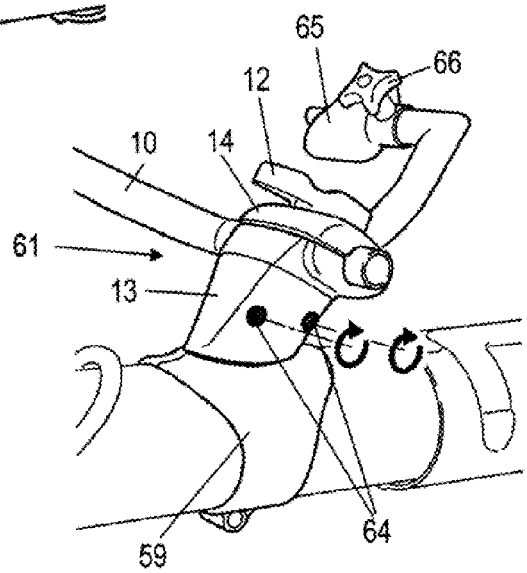
FIG. 8 shows the blower tube section of FIG. 7 with a mounting support disposed thereon.

FIG. 8 shows the clamp 59 with the mounting support 61 disposed thereon. The mounting support 61 is secured in the mounting openings 62 by means of the two fastening screws 64, which are illustrated schematically in FIG. 8. As also shown in FIG. 8, the handle frame 10 is provided with a receiving means or holding fixture 65 for the first handle 20; provided on the holding fixture 65 is a wing screw 66 for the securement and fixing of the rotational position of the holding fixture 65 relative to the handle frame 10.

Figure 9:
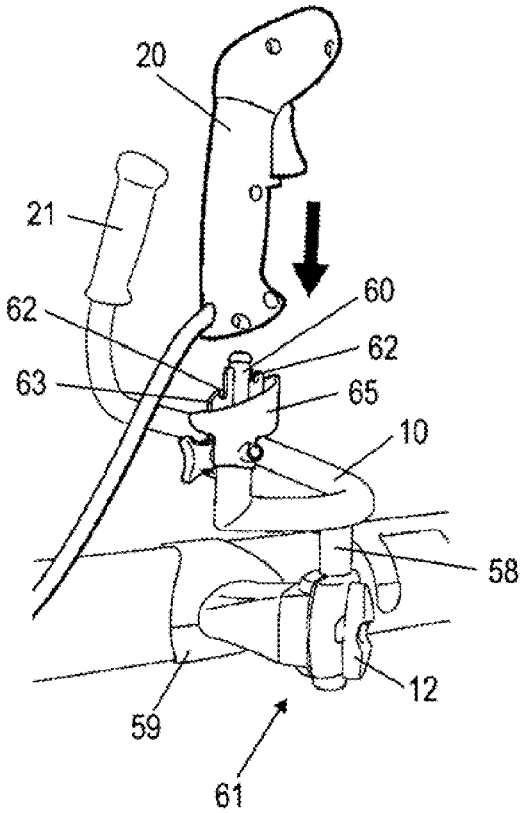
FIG. 9 is a perspective illustration of a blower tube section with a handle frame disposed thereon.

As shown in FIG. 9, the first handle 20 can be placed upon the holding fixture 65. For this purpose, the holding fixture 65 is provided with a short tube 60 and a longitudinal rib 63 having mounting openings 62, which essentially correspond to the short mounting tube 60, the longitudinal rib 63 and the mounting opening 62 on the clamp 59, so that the first handle 20 can selectively be secured in position directly on the clamp 59 or on the folding fixture 65 on the handle frame 10. As also shown in FIG. 9, the handle frame 10 is formed of a tubular section on which is secured a downwardly projecting support stud 58, which extends into the mounting support 61. The handle frame 10 is essentially disposed above the blower tube 7, and does not extend around the blower tube as does the embodiment of the handle frame 10 shown in FIG. 4. Due to the illustrated removable configuration of the first handle 20, the manually-guided implement can be guided not only in the conventional manner with the first handle, but also with two handles 20, 21 provided on a handle frame.

Figure 10:
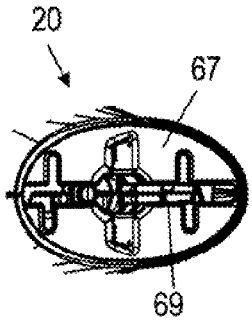
FIG. 10 is a view from below onto the first handle.

FIG. 10 shows a view onto the first handle 20 from that side that is placed upon the short tube 60. As shown in FIG. 10, the first handle 20 has an insertion region 67, which is provided with a central opening with a short tube 60 as well as an elongated opening 69 for receiving the longitudinal rib 63.

Figure 11:
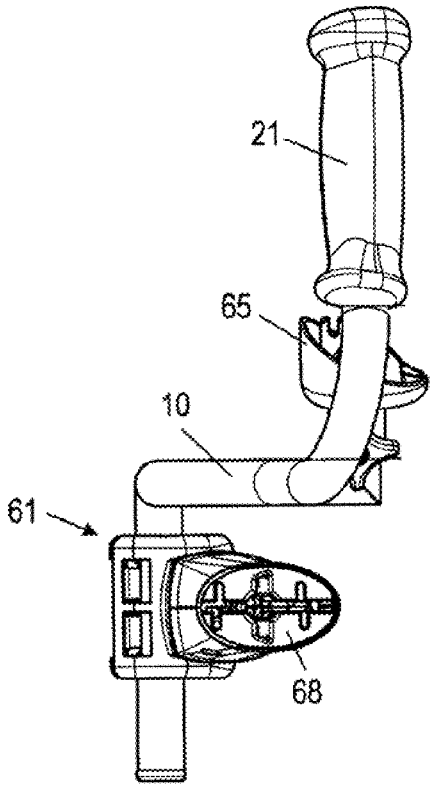
FIG. 11 is a side view of the mounting support with a handle frame.

FIG. 11 shows a view onto the insertion region 68 of the mounting support 61. As can be seen from FIGS. 10 and 11, the insertion regions 67 and 68 have an identical configuration. As a result, it is easily possible to selectively place either the handle 20 or the mounting support 61 on the short tube 60. The insertion regions 67 and 68 do not have to have an identical configuration, but rather need merely correspond functionally so as to enable insertion and fixation on a short tube 60.

The handle frame 10 can also be used on a tubular section of a suction or spray device. Use on other implements, especially on implements having a tubular section on which the handle frame can be secured, can also be advantageous.

The specification incorporates by reference the disclosure of German priority document 10 2005 046 227.8-15 filed Sep. 28, 2005.

The present invention is, of course, in no way restricted to the specific disclosure of the specification and drawings, but also encompasses any modifications within the scope of the appended claims.

We claim:

1. An implement, comprising:

a first handle, on which are disposed control elements of the implement and having a first insertion recess therein;

a tubular section;

a mounting support and a handle frame that is disposed on said mounting support, wherein the mounting support includes a second insertion recess that is similar to the first insertion recess;

a clamp having a first connecting protrusion thereon and that is detachably mounted on said tubular section;

wherein said first handle is capable of optionally being detachably mounted directly on the first connecting protrusion of said clamp and the first handle is alternatively capable of being directly connected to a second connecting protrusion, similar to the first connecting protrusion, on the handle frame with the mounting support being detachably mounted directly on the first connecting protrusion of said clamp, and wherein said implement is an implement that is adapted to be carried on the back of an operator; and wherein said tubular section is adapted to be guided in a single-handed operation by said first handle.

2. An implement according to claim 1, wherein a second handle is disposed on said handle frame.

3. An implement according to claim 1, wherein a holding fixture for said first handle is disposed on said handle frame.

4. An implement according to claim 1, wherein said first handle is detachably secured to said clamp by a set screw.

5. An implement, comprising:

a first handle, on which are disposed control elements of the implement;

a tubular section;

a clamp that is detachably mounted on said tubular section, wherein said first handle is detachably mounted on said clamp and is capable of being secured in position directly thereon, and wherein said implement is an implement that is adapted to be carried on the back of an operator;

a blower tube, wherein said tubular section is a section of said blower tube, and wherein said blower tube us adapted to be guided in a single-handed operation by said first handle;

a mounting support and a handle frame that is disposed on said mounting support, wherein said mounting support is adapted to be placed upon said clamp, and wherein a second handle is disposed on said handle frame; and wherein said clamp is provided with a longitudinal rib, and wherein said longitudinal rib fixes a rotational position of said mounting support or of said first handle.

* * * * *